US011125145B2

(12) United States Patent
Oslislok et al.

(10) Patent No.: US 11,125,145 B2
(45) Date of Patent: Sep. 21, 2021

(54) COOLING SYSTEM FOR A VEHICLE

(71) Applicant: Dr. Ing. h.c. F. Porsche Aktiengesellschaft, Stuttgart (DE)

(72) Inventors: Miroslaw Oslislok, Leonberg (DE); Tom Werner, Erlangen (DE); Tim Bouc, Muehlacker-Duerrmenz (DE)

(73) Assignee: Dr. Ing. h.c. F. Porsche Aktiengesellschaft

( * ) Notice: Subject to any disclaimer, the term of this patent is extended or adjusted under 35 U.S.C. 154(b) by 0 days.

(21) Appl. No.: 15/075,233

(22) Filed: Mar. 21, 2016

(65) Prior Publication Data

US 2016/0305306 A1 Oct. 20, 2016

(30) Foreign Application Priority Data

Apr. 17, 2015 (DE) ..... 10 2015 105 921.5

(51) Int. Cl.
*F01P 11/02* (2006.01)
*F01P 7/16* (2006.01)
*F01P 5/10* (2006.01)

(52) U.S. Cl.
CPC ..... *F01P 11/029* (2013.01); *F01P 7/165* (2013.01); *F01P 2005/105* (2013.01)

(58) Field of Classification Search
CPC ..... B60H 1/00885; B60H 1/323; B60H 2001/00928; B60H 2001/00957; B60H 2001/3289; B60H 2001/3248; F01P 11/029; F01P 7/165; F01P 2005/105
USPC ..... 123/41.01; 62/323.2
See application file for complete search history.

(56) References Cited

U.S. PATENT DOCUMENTS 4,913,107 A * 4/1990 Schweiger ..... F01P 11/0247 123/41.1
5,088,453 A * 2/1992 Kleineberg ..... F01P 3/2207 123/41.03
5,730,089 A 3/1998 Morikawa et al.
5,836,269 A 11/1998 Schneider
6,435,273 B1 * 8/2002 Futernik ..... B60H 1/00007 165/202
6,604,360 B1 * 8/2003 Vuk ..... F01N 5/04 123/41.11

(Continued)

FOREIGN PATENT DOCUMENTS

DE 41 31 357 7/1992
DE 199 48 160 4/2001

(Continued)

OTHER PUBLICATIONS

German Search Report dated Dec. 15, 2015.
English Translation of Korean Office Action dated Mar. 22, 2017.
Indian Examination Report dated Sep. 6, 2019.

*Primary Examiner* — Christopher R Zerphey
(74) *Attorney, Agent, or Firm* — Gerald E. Hespos; Michael J. Porco; Matthew T. Hespos

(57) ABSTRACT

A cooling system for a vehicle has a first cooling circuit, in which a first pressure prevails, and a second cooling circuit, in which a second pressure prevails. The first cooling circuit and the second cooling circuit share a common equalizing container for ventilating. The cooling system has a passive element that separates the first cooling circuit from the second cooling circuit if the first pressure is lower than the second pressure.

6 Claims, 1 Drawing Sheet

(56) References Cited

U.S. PATENT DOCUMENTS 7,128,025 B1 * 10/2006 Westhoff, Jr. ..... F01P 3/202 123/41.01
7,216,609 B2 5/2007 Theorell
8,851,026 B2 * 10/2014 Brinkmann ..... F01P 11/0285 123/41.02
9,709,065 B2 * 7/2017 Mehravaran ..... F01P 5/12
2002/0121554 A1 * 9/2002 Vaudry ..... F01P 5/10 236/34
2003/0029167 A1 * 2/2003 Hudson ..... F01P 7/165 60/598
2005/0138942 A1 * 6/2005 Grimm ..... B60H 1/00885 62/180
2005/0229873 A1 10/2005 Willers
2006/0032225 A1 * 2/2006 Dyne ..... F02B 37/10 60/607
2006/0213459 A1 * 9/2006 Theorell ..... F01P 3/2207 123/41.02
2008/0035647 A1 * 2/2008 Fuller ..... B60H 1/20 220/530
2010/0031901 A1 * 2/2010 Dahl ..... F01P 11/028 123/41.05
2012/0006286 A1 1/2012 Brinkmann et al.
2012/0090806 A1 * 4/2012 Beschieru ..... B60H 1/00278 165/41
2012/0180482 A1 * 7/2012 Kapich ..... F02B 37/10 60/608
2013/0153043 A1 * 6/2013 Payne ..... F15B 11/163 137/14

FOREIGN PATENT DOCUMENTS

DE 101 43 110 3/2003
DE 103 18 744 11/2004
DE 103 44 018 6/2005
DE 10 2007 054 855 5/2009
DE 10 2008 048 373 3/2010
DE 10 2009 051 377 5/2011
DE 196 08 748 1/2012
DE 10 2011 116 202 10/2012
DE 10 2011 114 308 3/2013
DE 10 2010 017 766 11/2013
DE 20 2014 102 510 8/2014
DE 10 2013 010 331 12/2014
DE 10 2013 217 154 3/2015
DE 10 2013 224 005 5/2015
EP 0 793 006 9/1997
JP 2010173445 A 8/2010

* cited by examiner

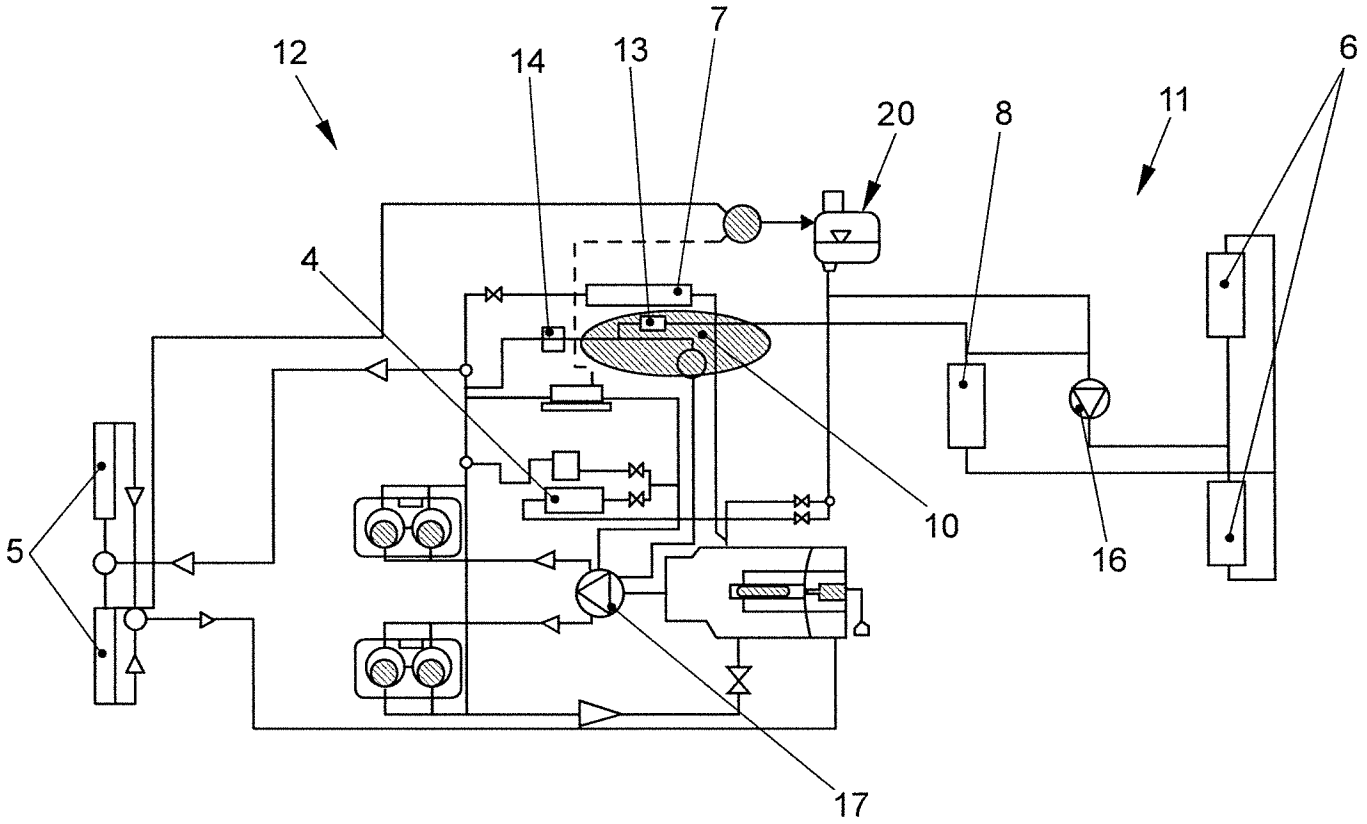
6
11
16
8
20
10
7
13
14
12
4
17
5

COOLING SYSTEM FOR A VEHICLE

CROSS REFERENCE TO RELATED APPLICATION

This application claims priority under 35 USC 119 to German Patent Appl. No. 10 2015 105 921.5 filed on Apr. 17, 2015, the entire disclosure of which is incorporated herein by reference.

BACKGROUND

1. Field of the Invention. The invention relates to a cooling system for a vehicle.

2. Description of the Related Art. The invention relates to a cooling system that comprises a plurality of cooling circuits, and with the individual cooling circuits having different temperature levels. Each cooling circuit typically has a dedicated equalizing container via which the cooling circuits can ventilate to avoid additional loading for one of the cooling circuits being produced by an interaction with the other cooling circuits, for example by way of a transfer of heat. As a result, a comparatively large amount of installation space is required and the overall weight is increased. Moreover, each equalizing container must be equipped with blow-off valves and/or coolant level sensors. During manufacture, moreover, the individual equalizing containers also make individual and therefore complicated filling necessary.

Furthermore, the prior art includes cooling systems in which the cooling circuits share a common equalizing container for ventilation. However, the actuation and control of individual electric switching valves has to ensure in a complicated manner that the individual cooling circuits are separated from one another at least temporarily.

It is an object of the invention to provide a simple cooling system for a vehicle in which plural cooling systems can share a common equalizing container without comparatively great complexity.

SUMMARY

The object of the present invention is achieved by way of a cooling system for a vehicle having a first cooling circuit, in which a first pressure prevails, and a second cooling circuit, in which a second pressure prevails. The first cooling circuit and the second cooling circuit share a common equalizing container for ventilating. The cooling system has a passive element that separates the first cooling circuit from the second cooling circuit if the first pressure is lower than the second pressure.

The passive element of the cooling system of the invention ensures that the first cooling circuit is separate from the second cooling circuit in an operation-induced manner to avoid or suppress additional loads of the first cooling circuit by way of the second cooling circuit. At the same time, the passive element ensures that the separation between the cooling circuits is canceled in those situations, in which no or only few interactions, for example unilateral thermal loads, are to be expected and thus permits the ventilating the first cooling circuit with utilization of the common equalizing container. The passive element utilizes a pressure difference or a pressure gradient between the first and the second cooling circuit for the independent separation. As a result, complicated actuation of valves is dispensed with. The cooling system also permits a reduction in the number of equalizing containers.

Passive elements are to be understood to mean those which fix their state as a result of an environmental variable, that is to say as a result of a physical parameter or parameter set that describes the environment of the passive element. The environmental variables may change their value when the cooling system or a part of the cooling system, in particular the second cooling circuit, is heated. Thus, the passive element reacts in a pressure-sensitive manner to its environment, namely the environmental variable, and ensures the separation of the cooling circuits independently if required by the operation-induced situation. For example, the first and second cooling circuits of the cooling system may comprise a cooling circuit for cooling the engine and a coling circuit for intercooling or for cooling high-voltage components. A temperature level of the first cooling circuit is at least temporarily different from the temperature level of the second cooling circuit.

The passive element may comprise a check valve that reliably separates the first cooling circuit from the second cooling circuit if the first pressure is lower than the second pressure. In particular, the passive element ensures a closure between the first and second cooling circuits.

The cooling system may further comprise an active element to keep the second pressure higher than the first pressure in a first operating state. As a result, the separation can be maintained in those situations in which the pressure difference that is required for the separation is not achieved without the active element, but canceling of the separation is undesired. This is the case, for example, if the pressure in the second cooling circuit is dependent on the engine speed. For example, a situation can arise in a traffic jam or during stop and go driving in which a temperature of the second cooling circuit lies above a temperature threshold value, but a speed threshold value that ensures the second pressure required for the separation in the second cooling circuit is not exceeded by the engine due to a rotational speed dependence of the pressure. Here, the speed fluctuations, for example in the use of a mechanical water pump, occur in the second cooling circuit. The active element in the second cooling circuit in the region of the passive element avoids the additional loading of the first cooling system in situations of this type. The speed threshold value may lie at 2000 rpm and the temperature threshold value may lie at approximately 40° C.

The active element may be deactivated in a second operating state of the vehicle. For example, the vehicle may be in the second operating state if the engine speed lies above the speed threshold value and the temperature of the second cooling circuit lies above the temperature threshold value. Since the engine speed lies above the speed threshold value, the second pressure that is provided for the desired separation of the first and second cooling circuits can be achieved without the action of the active element.

The separation by way of the passive element may be canceled if the vehicle is in a third operating state. For example, the vehicle may be in the third operating state if the engine speed lies below the speed threshold, preferably below a further speed threshold, and the temperature lies below the temperature threshold. In the third operating state, the risk of additional loading for the first cooling circuit is reduced and the first and/or the second cooling circuit are/is given the option of ventilation via the common equalizing container by canceling the separation by way of the passive element.

The active element may have an exhaust gas turbocharger afterrun pump, the second cooling system may be provided for engine cooling, and the first cooling system may be a low temperature cooling circuit. The pressure jump of the exhaust gas turbocharger afterrun pump can advantageously be utilized to ensure a closure of the check valve in the first operating state, thereby effectively ruling out an input of heat.

The invention is a method for operating the above-described cooling system. In accordance with the method, a first cooling circuit is separated from the second cooling circuit in first and second operating states by means of the passive element, and the separation by the passive element is canceled in the third operating state.

In a further embodiment of the method, the first cooling circuit is separated from the second cooling circuit in the first operating state by way of the direct or indirect action of the active element on the passive element.

The method may comprise ventilating the first cooling circuit and/or the second cooling circuit via the common equalizing container at a temperature of the second cooling circuit that lies below the temperature threshold.

Further details, features and advantages of the invention arise from the drawings and the following description of preferred embodiments using the drawings. Here, the drawings illustrate merely exemplary embodiments of the invention which do not restrict the essential concept of the invention.

BRIEF DESCRIPTION OF THE DRAWINGS

FIG. 1 shows a cooling system for a vehicle according to an exemplary embodiment of the present invention.

DETAILED DESCRIPTION

FIG. 1 shows a cooling system 1 for a vehicle according to an embodiment of the invention. The cooling system 1 comprises a first cooling circuit 11, such as a low temperature circuit for intercooling, and a second cooling circuit 12 that may be provided for engine cooling. The first cooling circuit 11 may comprise a plurality of cooling units, such as one or more low-temperature heat exchangers 6 and/or a low-temperature intercooler 8. The second cooling circuit 12 may comprise a plurality of cooling units, such as a right and left radiator 5, a wheel set heat exchanger 4 and/or a high-voltage heat exchanger 7. The first and second cooling circuits 11 and 12 preferably differ as a result of their respective temperature level. In particular, the temperature level of the first cooling circuit 11 is lower than the temperature level of the second cooling circuit 12. The use of a common equalizing container 20 for ventilating the individual cooling circuits instead of in each case individual equalizing containers affords advantages with regard to space savings, weight savings and cost savings. Moreover, only one filling operation is required during manufacture, which has a positive effect on the manufacturing time and the capacity in a production plant. Moreover, a single blow-off valve is sufficient to secure all cooling circuits against excess pressure, and only one common coolant level sensor is required. If the second cooling circuit 12 is an engine cooling circuit, a system pilot pressure of the engine cooling circuit can be made usable for all cooling circuits, as a result of which a tendency to boil of an indirect intercooler is reduced and pump cavitation decreases. Despite these numerous advantages, the prior art is configured so that each cooling circuit is provided with its dedicated equalizing container to avoid an exchange of heat between the cooling circuits and therefore additional loads for the cooling circuit with the lower temperature level, and impaired ventilation.

The illustrated embodiment of the invention is configured so that the first and second cooling circuits 11 and 12 have a common equalizing container 20. The first cooling circuit 11 is separated from the second cooling circuit 12 by a passive element 10 if a first pressure in the first cooling circuit 11 is lower than a second pressure in the second cooling circuit 12. For example, passive separation is realized by a check valve 13 between the first and second cooling circuits 11 and 12. Separation by the passive element 10 suppresses or prevents interactions, such as a transfer of heat, between the first and second cooling circuits 11 and 12. A separation is performed by the passive element 10, in particular by the check valve 13, when a first pressure in the first cooling circuit 11 is lower than a second pressure in the second cooling circuit 12. The first and second cooling circuits 11 and 12 remain separated from one another and a transfer of heat is prevented as long as the pressure gradient at the passive element 10 is maintained. In the illustrated embodiment, the second cooling circuit 12 comprises an engine cooling circuit, and the first cooling circuit 11 comprises a low temperature circuit. Furthermore, the passive element 10 ensures a separation of the engine circuit from the low temperature circuit independently if the second pressure becomes higher than the first pressure, the pressure development in the second cooling circuit 12 being fixed, for example, by way of its temperature and by way of an engine speed-dependent water pump 17. In contrast, the first cooling circuit preferably comprises an engine speed-independent water pump 16. The pressure gradient that is desired for the separation and in the case of which the second pressure is higher than the first pressure is set without further aids if an engine speed exceeds a speed threshold value, for example 2000 rpm, and the temperature in the second cooling circuit exceeds a temperature threshold value, for example 40° C. An active element 14 preferably is provided in the second cooling circuit 12 and maintains or brings about the desired pressure gradient at the passive element 10 if the engine speed lies below the speed threshold value and the temperature lies above the temperature threshold value. As a result, a separation of the first cooling circuit 11 from the second cooling circuit 12 can be ensured even in those situations in which the second cooling circuit 12 cannot ensure the desired pressure gradient independently, but the temperature of the engine cooling circuit represents a load for the low temperature circuit, and canceling of the separation by way of the passive element 10 is therefore undesired. In particular, the vehicle is in a first operating state if the temperature of the second cooling circuit 12 lies above the temperature threshold value and the engine speed lies below the engine speed threshold value, whereas the vehicle is in a second operating state if the temperature of the second cooling circuit 12 lies above the temperature threshold value and the engine speed likewise lies above the engine speed threshold value. For example, the vehicle assumes the first operating state during a stop and go drive or in a traffic jam. In situations of this type, the temperature difference between the temperature levels of the first and second cooling circuits 11, 12 is comparatively high, and canceling the separation between the cooling circuits would lead to a corresponding transfer of heat with the associated loads for the first cooling circuit 11. For example, the active element 14 comprises an exhaust gas turbocharger afterrun pump, the pressure jump of which can be utilized to increase the pressure at the passive element 10 on the side of the second cooling circuit 12 in such a way that the check valve 13 remains closed and a transfer of heat is suppressed or can be suppressed. In particular, the active element 14 and the passive element 10 are configured so that, in the first and second operating state, a closure takes place by way of the passive element 10 and ventilation is prevented. The ventilation preferably takes place in a third operating state, in which the engine has, for example, a speed of less than 1000 rpm and the temperature of the second cooling circuit lies below the temperature threshold value. In the third operating state, the active element 14 is deactivated and the second pressure is lower than the first pressure. As a result, the separation by way of the passive element 10 is canceled automatically and ventilation can take place if the load for the first cooling circuit 11 by way of the second cooling circuit 12, in particular by way of a possible input of heat, is low in comparison with the loads in the first and second operating state.

LIST OF DESIGNATIONS

1 Cooling system
4 Wheel set heat exchanger
5 Right-hand and left-hand radiator
6 Low temperature heat exchanger
7 High-voltage heat exchanger
8 Intercooling means
10 Passive element
11 First cooling circuit
12 Second cooling circuit
13 Check valve
14 Active element
16 Engine speed-independent water pump
17 Engine speed-dependent water pump

What is claimed is:

1. A cooling system for a vehicle comprising:

a first cooling circuit having a first pump for pumping a cooling fluid through the first cooling circuit so that a first pressure prevails;

a second cooling circuit having a second pump for pumping the cooling fluid through the second cooling circuit so that a second pressure prevails, the second cooling circuit being connected to an engine of the vehicle and configured for engine cooling;

a common equalizing container, the first cooling circuit being in direct communication with a port of the common equalizing chamber for ventilating, and the second cooling circuit being in communication with the port of the common equalizing chamber only via the first cooling circuit;

a passive element that separates the second cooling circuit from the first cooling circuit and the port of the common equalizing chamber if the first pressure is lower than the second pressure; and an active element in the second cooling circuit and in communication with the passive element, the active element bringing about a desired pressure gradient at the passive element at specified engine and temperature threshold values, wherein the cooling system is configured so that:

the active element produces pressure conditions that cause the passive element to maintain a separation of the first cooling circuit from the second cooling circuit during a first operating state in which a temperature of second cooling circuit is above the threshold value, an engine speed is below the threshold value and the first pressure is below the second pressure;

the active element produces pressure conditions that permit the passive member to maintain the separation of the first cooling circuit from the second cooling circuit during a second operating state in which the temperature of the second cooling circuit is above the threshold value, the engine speed is above the threshold value and the first pressure is below the second pressure; and separation of the first cooling circuit from the second cooling circuit by the passive element is canceled during a third operating state in which the temperature of the second cooling circuit is below the threshold value, the engine speed is below the threshold value and the first pressure is above the second pressure so that ventilation of the first cooling circuit is permitted at the common equalizing container via the second cooling circuit.

2. The cooling system of claim 1, wherein the passive element comprises a check valve.

3. The cooling system of claim 1, wherein the active element is an exhaust gas turbocharger afterrun pump, and the first cooling circuit is provided for cooling electrical components.

4. A method for operating the cooling system of claim 1, comprising using the passive element to separate the first cooling circuit from the second cooling circuit in the first and second operating states, and using the active element for canceling the separation by the passive element in the third operating state.

5. The method of claim 4, further comprising separating the first cooling circuit from the second cooling circuit in the first operating state by way of direct or indirect action of the active element on the passive element.

6. The method of claim 4, further comprising ventilating the first cooling circuit via the common equalizing container and/or ventilating the second cooling circuit via the first cooling circuit and the common equalizing container at a temperature of the second cooling circuit that lies below a temperature threshold.

* * * * *